US007073295B2

(12) United States Patent
Pressutti et al.

(10) Patent No.: US 7,073,295 B2
(45) Date of Patent: Jul. 11, 2006

(54) FRONT FOLD RIDGE COVER AND METHOD OF MAKING

(76) Inventors: Joseph Pressutti, 3441 S. Willow, Fresno, CA (US) 93725; Lawrence Penner, 3441 S. Willow, Fresno, CA (US) 93725

( * ) Notice: Subject to any disclaimer, the term of this patent is extended or adjusted under 35 U.S.C. 154(b) by 0 days.

(21) Appl. No.: 10/417,855

(22) Filed: Apr. 17, 2003

(65) Prior Publication Data

US 2004/0206012 A1 Oct. 21, 2004

(51) Int. Cl.
*E04B 7/00* (2006.01)

(52) U.S. Cl. ..... 52/57; 52/528; 52/745.19; 52/748.1

(58) Field of Classification Search ..... 52/518, 52/528, 745.19, 747.1, 744.1, 198, 514, 57
See application file for complete search history.

(56) References Cited

U.S. PATENT DOCUMENTS 3,913,294 A * 10/1975 Freiborg ..... 52/518
4,404,783 A * 9/1983 Freiborg ..... 52/518
4,434,589 A * 3/1984 Freiborg ..... 52/57
4,439,955 A * 4/1984 Freiborg ..... 52/57
4,920,721 A * 5/1990 Pressutti et al. ..... 52/518
5,094,042 A * 3/1992 Freborg ..... 52/57
5,319,898 A * 6/1994 Freiborg ..... 52/52
5,365,711 A * 11/1994 Pressutti et al. ..... 52/518
5,375,388 A * 12/1994 Poplin ..... 52/560
5,377,459 A * 1/1995 Freiborg ..... 52/57
5,471,801 A * 12/1995 Kupczyk et al. ..... 52/57
5,685,117 A * 11/1997 Nicholson ..... 52/520
5,950,387 A * 9/1999 Stahl et al. ..... 52/559
6,070,384 A * 6/2000 Chich ..... 52/518
6,182,400 B1 * 2/2001 Freiborg et al. ..... 52/57
6,351,913 B1 * 3/2002 Freiborg et al. ..... 52/57

* cited by examiner

*Primary Examiner*—Korie Chan
(74) *Attorney, Agent, or Firm*—Terry L. Miller

(57) ABSTRACT

A shingle ridge cover is formed from an elongate sheet of shingle roofing material back folded on itself to provide a folded and thickened front lower edge of the shingle ridge cover. The shingle ridge cover provides upwardly disposed stripes of adhesive material providing for interbonding of successive ridge covers on a roof, and a rearwardly disposed strip of non-adherence material providing for the ridge covers to be stacked and shipped to a job site substantially without the stacked ridge covers adhering to one another.

13 Claims, 3 Drawing Sheets

FRONT FOLD RIDGE COVER AND METHOD OF MAKING

BACKGROUND OF THE INVENTION

Field of the Invention

The present invention relates to an aesthetic front-fold shingle or ridge cover for roofing. More particularly, the present invention relates to a shingle ridge cover that is particularly efficient to manufacture, makes efficient use of materials, is durable, economical to ship, aesthetically pleasing as installed on a roof, and which provides a double layer of shingle material over the underlying roof structure.

As installed on a roof, the inventive shingle ridge cover also has a particularly attractive appearance which is somewhat like a comparatively thick wood shake. That is, the configuration of the present shingle ridge cover gives an appearance of depth and creates shadow lines at adjacent ridge covers on a roof. It is these shadow lines and the appearance of depth which are considered among the principal aesthetically pleasing aspects of a wood shake roof. Those ordinarily skilled in the pertinent arts will recall that the shadow line appearance of a wood shake roof varies in dependence on prevailing lighting conditions. That is, the shadow line effect on a shake roof depends upon the intensity and direction of prevailing light. A roof utilizing the present inventive shingle ridge cover is substantially the same, with its appearance changing as lighting conditions change. Thus, the roof has a dynamic and changing appearance, which also adds interest to the roof. On the other hand, the present shingle ridge cover provides fire protection which is much better than that provided by conventional wood shakes.

Further, with the configuration of the present inventive front-fold shingle ridge cover, each shingle ridge cover provides a step in the depth of the shingle covering extending along a ridge (or possibly along a hip, or rake) of a roof, for example. In this respect, the present inventive shingle ridge cover is also not unlike a wood shake, in that the wood shake itself because of its own thickness at its lower edge provides a thickness step on a roof or along a ridge. It is these thickness steps that are visible from a distance, and which also create the attractive and dynamic shadow lines on a roof, Thus, each front-fold shingle ridge cover alone and independently of adjacent ridge covers, provides a thickness step which, depending on lighting conditions, can throw a dynamic and attractive shadow line on a roof, just like a wooden shake.

SUMMARY OF THE INVENTION

In view of the above, the present invention provides an improved front-folded shingle (or front-fold shingle ridge cover) which is particularly configured to provide ease of installation, and to provide an appearance of depth and thickness at adjacent shingle ridge covers on a roof as installed.

The inventive ridge cover has an upper section that is wider than the underlying section over substantially all of the length of the underlying section, so that the side edges of the underlying section are more effectively concealed.

Further, the inventive ridge cover includes provision to relieve stresses produced by differential thermal expansion, and to thus prevent curling, wrinkling, or warping of the ridge cover as installed because of such differential thermal expansion.

The apparent depth of the present inventive front-folded shingle ridge cover according to a preferred embodiment of the invention can be substantially equal to a double thickness of the sheet shingle material from which the shingle ridge cover is made.

An alternative embodiment of the front-folded shingle ridge cover invention provides a shingle ridge cover in which the apparent depth of each shingle ridge cover is substantially equal to four times the thickness of the sheet shingle material from which the shingle ridge cover is made.

Other alternative embodiments of the present inventive shingle ridge cover may provide still greater apparent depths for each shingle ridge cover according to the wishes of the manufacture of the shingle ridge cover. That is, this present inventive shingle ridge cover by its design provides for a selection of the thickness and appearance of the shingle ridge cover by an easy change in the manufacturing process.

The invention provides methods of making the shingle ridge covers.

The present inventive shingle ridge cover is formed of a base sheet or work piece of fiberglass mat or felt with impregnating asphaltic material modified to make it pliable. The shingle ridge cover is back folded at one end (i.e., at the front end or lower end of the completed shingle ridge cover) on itself to form the lower end edge of the shingle ridge cover. This back folded lower end edge of the ridge cover is of at least twice the thickness of the sheet shingle material from which the shingle ridge cover is formed, and the thickness of this folded lower end edge of the shingle ridge cover provides an appearance of thickness for the ridge cover as installed on a roof. The overlying section of the ridge cover is generally rectangular while the underlying section is trapezoidal with a base dimension substantially the same as the width of the overlying section. The rectangular section and trapezoidal section are joined to one another at a fold in the work piece, or by a folding region of the work piece.

An alternative embodiment of the shingle ridge cover is back folded on itself at least twice adjacent to the lower end edge of the shingle ridge cover so that the back folded sections of the work piece are stacked atop one another, and cooperate to provide a substantial thickness for the shingle ridge cover at its lower end edge.

Consequently, as installed on a roof and viewed from a distance by a person on the ground, the present inventive shingle ridge cover appears to have a substantial depth, and to provide plural shadow lines, somewhat like a wood shake. However, the improved material from which the present shingle ridge cover is fabricated combined with its double-layer coverage provided to the underlying roof structure, provides much better protection to the roof structure, and improved durability for the roof covering.

Also, the present inventive shingle ridge cover offers improved ease and economy of manufacture.

Further, because of the inventive configuration of this present shingle ridge cover, efficient packing of plural manufactured shingle ridge covers in a flat configuration into boxes for shipment to a job site (i.e., where the shingle ridge covers are installed on a roof) is facilitated. That is, the shingle ridge covers are configured to nest together, so as to more efficiently and completely fill a shipping box with very little ullage volume. Accordingly, shipping costs for these shingle ridge covers from their place of manufacture to job sites for installation are reduced.

Additional objects and advantages may be appreciated from a reading of the following detailed description of exemplary and preferred embodiments of the invention taken in conjunction with the following drawing Figures, in which:

BRIEF DESCRIPTION OF THE DRAWING FIGURES

FIG. 1 provides a fragmentary perspective view of plural shingle ridge covers embodying the present invention installed along a ridge of a roof;

Figure 1:
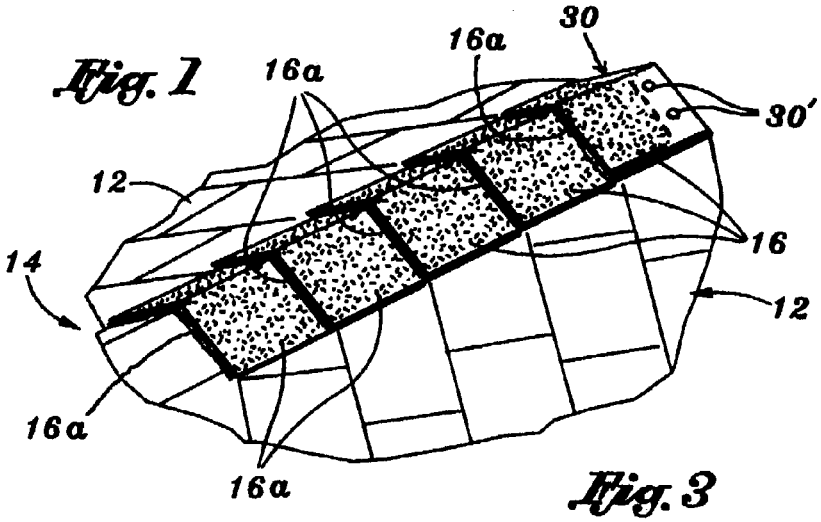
Figure 2:
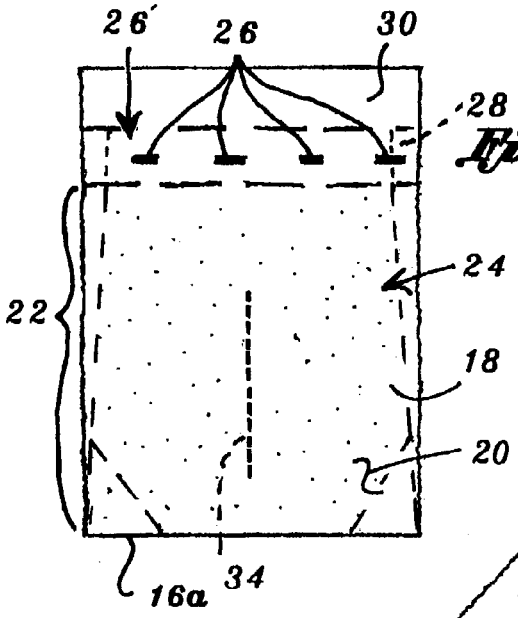
FIG. 2 is a top plan view of a shingle ridge cover embodying the present invention.
Figure 3:
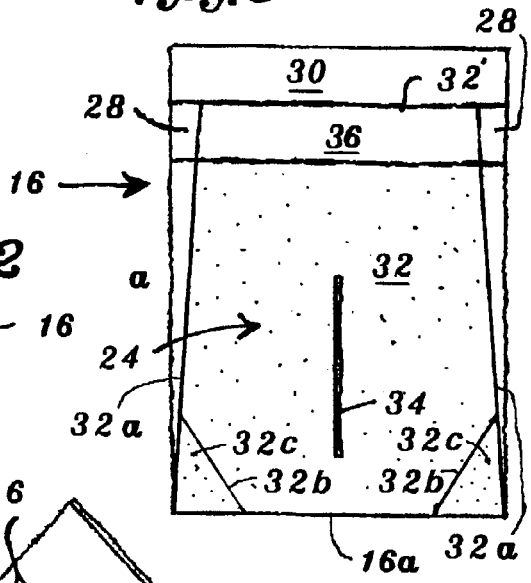
FIG. 3 is a bottom plan view of a shingle ridge cover embodying the present invention.
Figure 6:
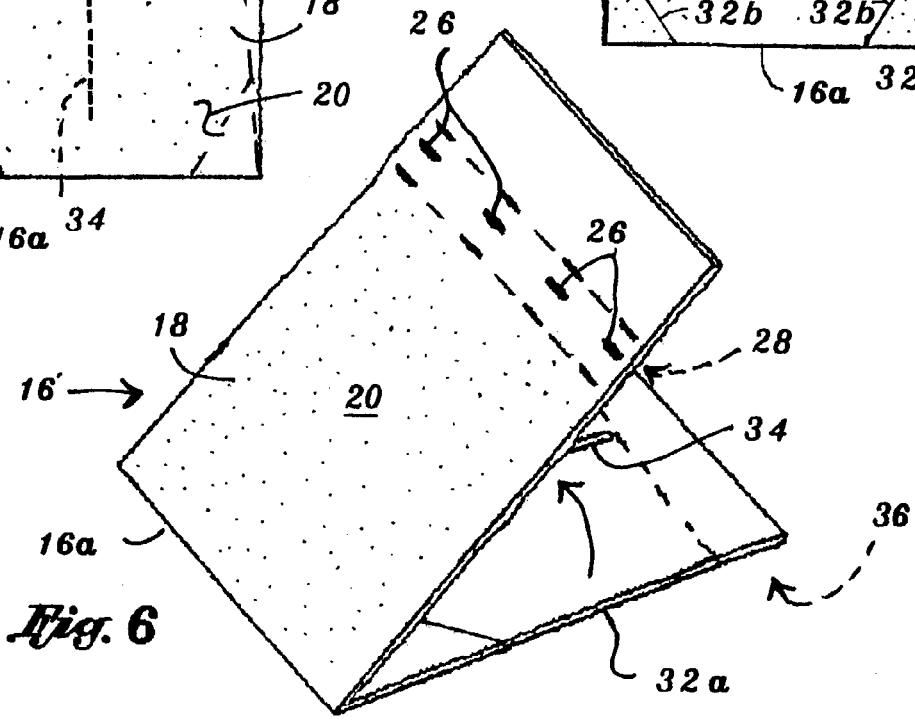
Figure 4:
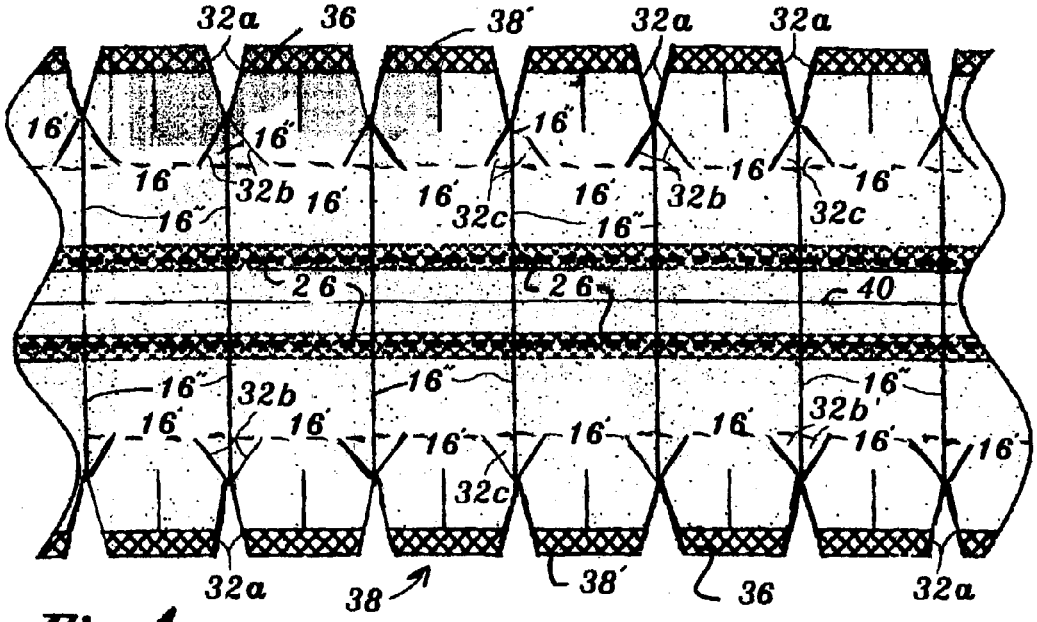
Figure 5:
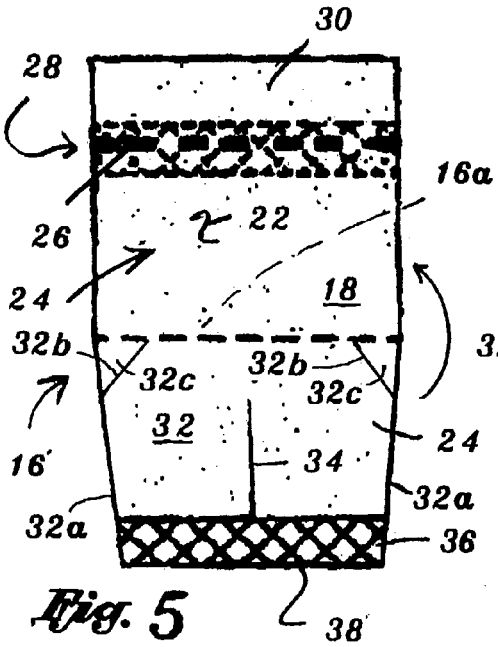
Figure 7:
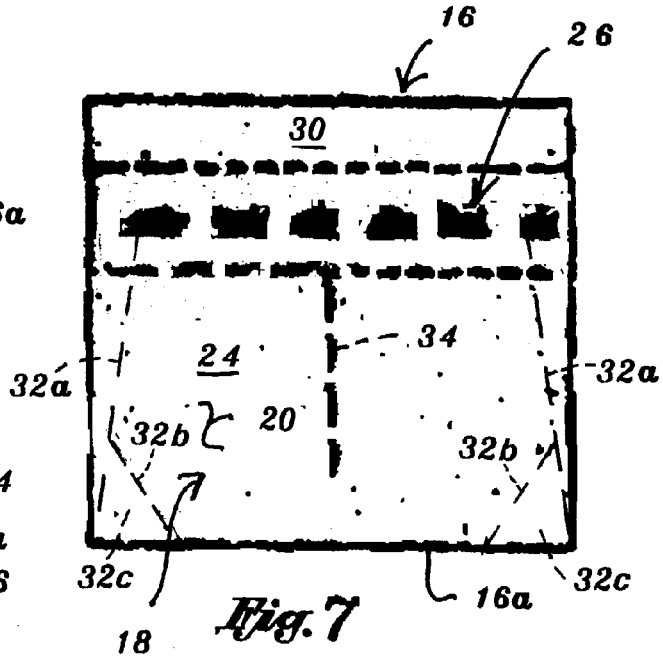
Figure 8:
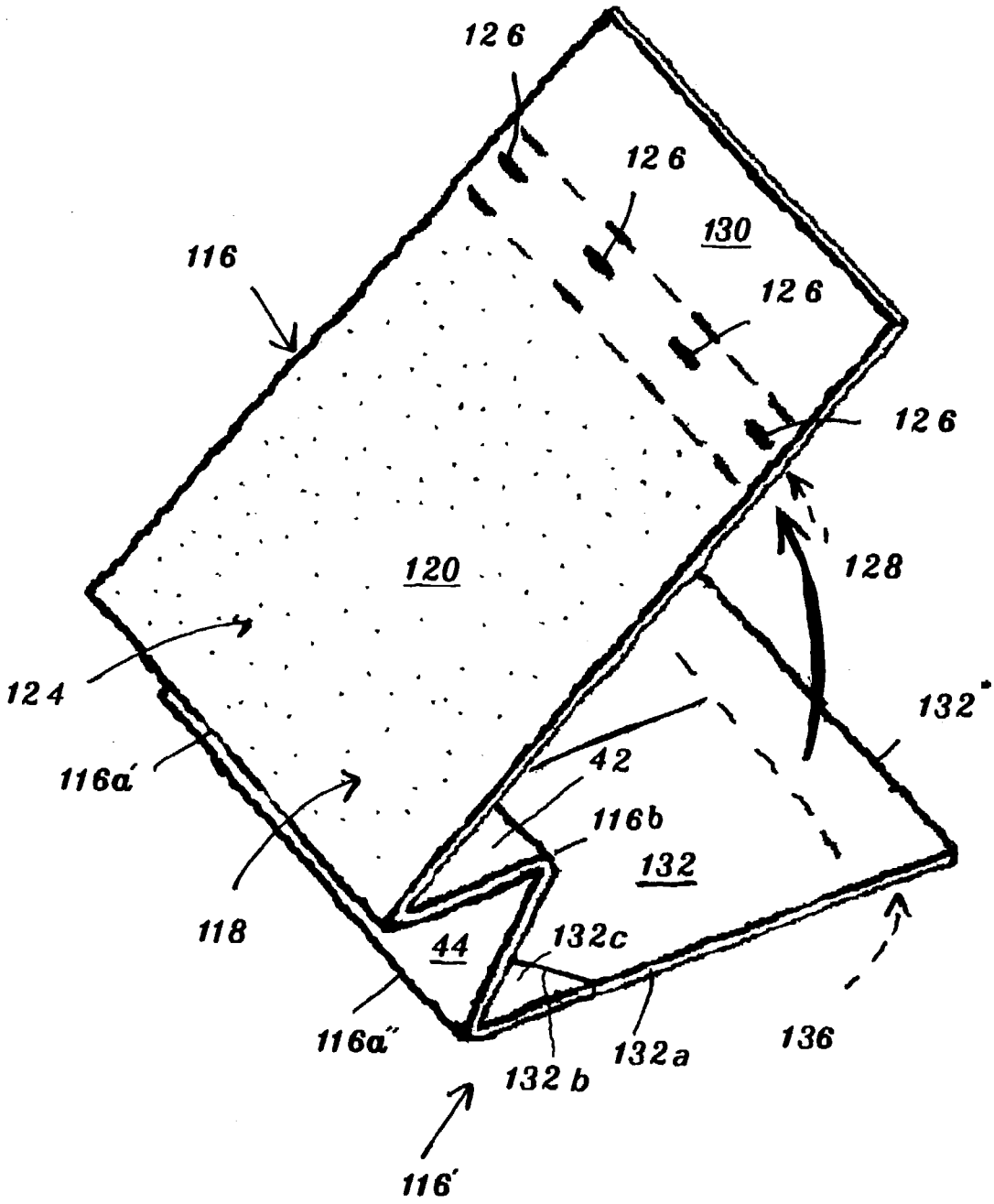

FIG. 4 provides a plan view of an manufacturing intermediate article from which plural shingle work pieces as seen in FIGS. 1–3, and in FIGS. 5 and 6 will be cut at a subsequent stage of manufacturing;

FIG. 5 depicts in top plan view a shingle work piece made from the manufacturing article of FIG. 4, and from which a shingle ridge cover as seen in FIGS. 1–3 is made;

FIG. 6 provides a diagrammatic perspective view of the shingle work piece of FIG. 5 at a subsequent stage of manufacturing a shingle ridge cover;

FIG. 7 depicts in top plan view the shingle work piece of FIGS. 5 and 6, and subsequent to the folding step illustrated in FIG. 6, resulting in a finished, front-folded shingle ridge cover as seen in FIGS. 1–3; and FIG. 8 provides a diagrammatic perspective view similar to that of FIG. 6, but showing an alternative embodiment of a front-folded shingle ridge cover, with the shingle ridge cover being unfolded slightly in order to better illustrate the structure of this embodiment.

DESCRIPTION OF PREFERRED EXEMPLARY EMBODIMENTS OF THE INVENTION

Viewing the drawing Figures in conjunction with one another, and viewing first FIG. 1, a roof 10 is seen to include a pair of generally planar and conventional shingle-covered inclined surfaces or fields 12, which intersect with one another at a horizontally extending ridge 14. At the ridge 14, the roof 10 includes a plurality of aligned and partially overlapping front-fold shingle ridge cover members 16 (hereinafter, referred to as "shingle ridge covers "). The front-fold shingle ridge covers 16, as installed along the horizontal ridge 14, have a chevron shape in end view, as is best seen in FIG. 1.

Those ordinarily skilled in the pertinent arts will appreciate that the same type of front-fold shingle ridge cover 16 employed at the ridge 14 may possibly be used also at the hips and rakes (not shown) of the roof 10. Such hips and rakes are inclined intersections of shingled surfaces of a roof. Further, it is to be understood that the included angle (i.e., the angle of the chevron shape) at a particular ridge, hip, or rake will vary depending on the particular construction details and design of the particular roof. Thus, the included angle of the chevron shape of the ridge covers 16 also will also vary as required for installation on the roof. The ridge covers 16 are sufficiently flexible to allow this variability in the included angle of the chevron shape in end view as the shingle ridge covers are installed and secured (i.e., nailed or stapled, for example) on a roof, as will be more apparent in view of the following description.

Further, as is seen in FIG. 1, the shingle ridge covers 16 each have a folded front (or lower) edge 16*a*, which is of sufficient thickness that each of these edges 16*a* makes a respective and apparent step in the thickness of the roof covering extending along the ridge 14. These steps at the front edges 16*a* of the ridge covers 16 are apparent when the roof 10 is viewed from a distance (i.e., by a person on the ground, for example) and these thickness steps at the edges 16*a* also can cause shadow lines on the roof 10 dependent on prevailing lighting conditions. Thus, the roof 10 has a dynamic appearance of changing shadow lines at the steps 16*a*, varying with lighting conditions and varying with the point from which the roof is viewed. These factors all add interest and aesthetic attractiveness to the roof 10.

As is more particularly shown in FIGS. 2 and 3, the front-fold shingle ridge cover 16 is generally rectangular in plan view, is made of folded sheet shingle material (i.e., from a work piece 16' of sheet shingle material—to be further described below), and includes a thickened, under-folded front or lower portion 18 which is two layers of shingle material in thickness everywhere, and which at the front edge 16*a* is two or more layers of the sheet shingle material in thickness. That is, the portion 18 defines the thickened front edge 16*a* for the ridge cover 16.

Further, as is seen in FIG. 1, the top section 20 of the ridge cover is generally rectangular and includes a surface 20*a* with a field 22 covered with granular material 24 (represented by stippling on the drawing Figures). Those ordinarily skilled in the pertinent arts will understand that although the granular material 24 is represented by stippling which does not entirely cover the entire field 22 (i.e., there are spaces between the stippling dots), the granular material does cover the entire field 22. This granular material 24 is of selected colors or color combinations, so that the ridge cover 16 may be made in differing colors and to have differing appearances and levels of contrast to the shadow lines at the steps 16*a*, further adding aesthetic appeal to the roof 10. Further, this granular material entirely covers the face 20 of the shingle ridge cover 16 in order to provide to the asphaltic base sheet from which the work piece 16' is made protection from ultraviolet light. Otherwise, this ultraviolet light would deteriorate this asphaltic base sheet.

Viewing FIG. 2, it is seen that the field 22 extends from the front edge 16*a* toward and almost to a line of adhesive stripes 26. The stripes 26 are of asphaltic material and provide for an overlying shingle ridge cover (recalling how these ridge covers are installed on roof 12, as seen in FIG. 1) to adhere in order to resist being lifted by strong winds. The stripes 26 of adhesive are disposed somewhat above the top of the field 22 of granular material 24, and are disposed about midway of the width of a strip of mylar tape 28, depicted by dashed lines in both FIGS. 2 and 6. Further, the stripes 26 of adhesive material provide an effective installation guide for installation of successive ridge covers on a roof. That is, the folded lower front end edge 16*a* of a next-successive ridge cover 16 is positioned just slightly below the line of stripes 26 of a preceding ridge cover, and in this position the next successive ridge cover is secured to the roof 14 by fasteners 30' (recalling FIG. 1).

The lower edge of the strip 28 of mylar tape is at the upper extent of the field 24. This mylar tape 28 is applied on the reverse side of the section of sheet shingle material defining surface 20, and will be seen to be a non-adherence material. That is, the strip of mylar tape 28 keeps the ridge covers 16 (or ridge cover work pieces 16' or a manufacturing intermediate article including several of these work pieces) from undesirably sticking to one another during manufacturing or shipping of the ridge covers 16. Also, above the field 22, and above the stripes of adhesive material 26, the ridge cover 16 defines a nailing region 26', indicated by the arrowed numeral on FIG. 2, and as will be further explained. As is best seen in FIG. 1, the ridge cover 16 is secured to the underlying structure of roof 10 by use of roofing nails 30' (or of roofing staples, for example) penetrating the nailing margin 26' and securing into the underlying roof structure.

Further considering FIGS. 1–3, and 6, it is seen that the ridge cover 16 includes a rear or "folded under" section 32 extending from the front edge 16*a* (i.e., from the fold defining this front edge 16*a*). At an upper end 32' of this rear section 32, the edge 32' is substantially aligned with the upper edge of the strip of mylar tape 28. This rear section 32 also defines a centrally disposed elongate folding slot 34. The folding slot 34 provides relief for flexibility of the ridge cover to be bent or flexed into the necessary chevron shape, recalling FIG. 1. This elongate relief slot may extend nearly to the lower edge 16*a*, and may extend nearly to the upper edge 32' of the rear portion 32, dependent on how much relief is necessary to allow flex or bending of the ridge cover 16 to its chevron shape. Alternatively, the relief slot 34 may be formed as a discontinuous slot. That is, the slot 34 may be formed of an aligned plurality (i.e., two or more) relief slot sections, which are centrally located and extend between the edge 16*a* and the edge 32'.

Considering particularly FIG. 3, it is seen that the folded under section 32 is not shaped rectangularly, as is the front view of the ridge cover seen in FIG. 2. In other words, the section 32 is trapezoidally shaped, having a base or major side at the folded edge 16*a*, a minor side at the edge 32', and two angulated side edges 32*a*. Because the section 32 is somewhat narrower substantially over its entire length (except at the folded edge 16*a*) than is the upper section 20, the side edges 32*a* are effectively concealed from view. Also, the ridge cover 16 can better tolerate a slight misalignment of the upper section 20 and lower section 32 without either of the side edges 32*a* becoming visible.

Further to the above, the folded under section 32 defines a pair of oppositely angulated slits 32*b*, each extending from the folded edge 16*a* adjacent but spaced from a respective side edge 32*a* at the fold 16*a*, and to a position intermediate along the length of the respective side edge 32*a* part way to the opposite edge 32'. This pair of slits 32*b* define a pair of delta shaped portions 32*c* which are part of the folded under section 32. Each delta shaped portion 32*c* lies in the same plane as the remainder of the section 32 while the ridge cover is flat as seen in FIGS. 2 and 3. However, when the ridge cover 16 is folded or creased to its chevron shape as seen in FIG. 1, the slits 32*b* allow the portions 32*c* to slightly overlap with the remainder of section 32.

That is, each delta shaped portion 32*b* may slip slightly between the front portion 18 and the section 32, or alternatively, may slip behind (i.e., under) the section 32 as the ridge cover is folded or creased to its chevron shape for installation on a roof along a ridge, hip, or rake, for example. As thus positioned, the delta shaped portions 32*c* provide for relief of differential thermal expansions experienced between the portion 18 (which is directly exposed to solar radiant head, for example) and the section 32 (which is shielded from direct solar radiation by the overlying portion 18). Accordingly, curling, warping, wrinkling and/or buckling of the ridge cover 16 as a result of such differential thermal expansions is avoided.

Further to the above, still viewing FIG. 3 it is seen that the folded under portion 32 is both trapezoidal in shape, as well as including within itself an irregular hexagonally shaped part. This hexagonally shaped part is defined by the folded edge 16*a*between the intersections of the cuts 32*b* with this edge, by the two cuts 32*b*, by the two side edges 32*a*, and by the end edge 32'. Thus, the folded under portion 32 may properly be said to include or define both a trapezoidal shape, and an irregular hexagonal shape. The two delta shaped sections 32*c* added together with the irregular hexagonal shape yields the trapezoidally shaped part of the folded under section 32.

Considering now FIGS. 3 and 6 in particular, it is seen that the ridge cover 16 includes another strip 36 of mylar tape. This strip 36 is disposed on the rear face of the rear portion 32, and when the ridge cover 16 is folded into its finished condition with the rear portion 32 immediately behind portion 20, then the strip 36 is substantially congruent and aligned with the strip 28 (viewing particularly FIG. 3).

Turning now to FIG. 4, a shingle ridge cover manufacturing intermediate article 36 is seen at an intermediate stage of manufacture. This shingle ridge cover manufacturing intermediate article is configured as an elongate strip of shingle material (i.e., perhaps cut from a larger piece of shingle material) and the manufacturing intermediate article 36 includes plural shingle ridge cover work pieces 16' disposed along its length. The work pieces 16' are aligned with one another across a line of elongate symmetry 40, as is shown in FIG. 4. As seen in FIG. 4, the work pieces 16' are disposed with the granule coated surface 20 upward in this Figure. Further, the strips of mylar tape 36 are upward, and the manufacturing intermediate article defines a pair of opposite side edges 38', which will become the end edges 32' for the respective shingle work pieces 16' when these are separated from the article 38. The article also includes strips 28 of mylar tape (which are on the underside of the article as seen in FIG. 4), as well as including the lines 26 of plural adhesive stripes of asphaltic material. Further, it is to be understood that the individual shingle member work pieces 16' are to be separated from one another along cutting or tearing lines indicated with the numeral 16", as well as being separated from one another along the symmetry line 40.

Moreover, it will be appreciated that the manufacturing intermediate article 38 has a line of symmetry at the line 40, so that it has a mirror image appearance at this line 40. On each side of the line 40, the manufacturing intermediate article 38 includes or defines plural shingle ridge cover work pieces 16', each of which will become a finished front-folded shingle ridge cover 16 upon further manufacturing steps, as will be explained. The shingle ridge cover work pieces 16' are separated from one another by and at the lines indicated at 16" on FIG. 4. The lines 16" may be cutting location lines that do not actually exist physically in the manufacturing intermediate article 38, or may alternatively be score lines or slits (or a combination thereof) actually formed in the manufacturing intermediate article 38. In the case of score lines or slits actually being formed in the manufacturing intermediate article 38 at the locations indicated by lines 16", then the work pieces 16' may perhaps be separated from one another without the need for cutting at the lines 16". That is, tearing, or a combination of creasing and tearing might be used to separate the work pieces 16' from the manufacturing article 38.

Still further considering the manufacturing intermediate article 38, it is to be understood that during manufacturing of the ridge covers 16, this intermediate article may have to be rolled on itself preparatory to separation of the shingle ridge covers 16 out of this article. Thus, it is understandable how the strips 28 of mylar tape align with the stripes 26 of adhesive while the article 38 is rolled on itself in order to prevent successive wraps of the article from adhering to itself.

On the other hand, the result of the separation of one of the shingle ridge cover work pieces 16' from the article 38 is seen in FIGS. 5, 6, and 7. FIG. 5 shows a work piece 16' in its condition immediately after separation from the article 38. A dashed line indicated with arrowed numeral 16*a* on FIG. 5 indicates the location of the fold to be made in order to define the end edge 16*a* of the shingle ridge cover, recalling FIGS. 2 and 3. As is seen in FIG. 6, the work piece 16' is folded at line 16*a* to define end edge 16*a* of the finished shingle ridge cover member, with the portion 32 being folded up and behind the front portion 18, as is indicated by the arcuate arrow on FIG. 6.

The folding operation shown in FIG. 6 results in the strip 36 of tape coming into alignment and congruence with the strip 28 of tape, and with the end edge 32' coming into substantial alignment with the upper edge of the strip 28 of tape. Thus, for the finished folded shingle ridge cover member (as is seen in FIG. 7), it is the strip of tape 36 which prevents stacked shingle ridge covers from adhering to one another. Thus, the finished shingle ridge cover members 16 as seen in FIG. 7 may be stacked one atop of another in their flat condition within a shipping box. The stacked finished ridge cover members do not adhere to one another during shipping, and can be easily removed individually from the shipping box for installation on a roof.

It will be recalled that this installation involves the installer bending or flexing the shingle ridge cover members 16 from their flat condition seen in FIGS. 2 and 7, and into their chevron shape as seen in FIG. 1. As the finished shingle ridge cover member 16 is flexed or bent from its flat condition to the chevron shape, the relief slot 34 eases this flexing or bending, and insures that the chevron shape is centered generally on the slot 34. The shingle ridge covers 16 are successively placed and secured on the roof 10 with the lower end edge 16*a* generally aligned with the lower edges of the strips 28 and 36 of mylar tape. That is, the lower end edge 16*a* is placed just beyond or below the stripes 26 of adhesive. Thus, these stripes 26 of adhesive adhere each successive shingle ridge cover member to the prior shingle ridge cover. This adherence is effected to the lower or underlying ridge cover member adjacent to the fasteners 30' securing the underlying ridge cover. These fasteners 30' are placed through the nailing margin 26' of the ridge cover 14 just above the line 26 of stripes of adhesive inaterial, and below the upper edge 32 of the rear portion 32. Thus, the fasteners 30' penetrate two thicknesses of the work piece 16' making up the ridge cover 16, and provide secure attachment of the ridge cover to the ridge 14 of the roof 10. Thus, the resistance of this shingle ridge cover member against being lifted by high wind is particularly good. The comparatively thick lower end edges 16*a* of the installed shingle ridge covers 16 are able to provide an appearance of depth on the roof 10, as well as plural spaced apart dynamic shadow lines on this roof, recalling the explanation above.

Continuing with a consideration of the drawing Figures, FIG. 8 illustrates an alternative embodiment of shingle ridge cover 116 according to the present invention. The shingle ridge cover 116 of FIG. 8 is shown in a view similar to that of FIG. 6 of the first embodiment. Because the second embodiment of shingle ridge cover includes many features that are the same as or analogous to those of FIGS. 1–7, these features of FIG. 8 are referenced using the same numeral used above, and increased by one-hundred (100). Viewing now FIG. 8 it is seen that a front-fold shingle ridge cover member 116 includes a dual front fold edge, indicated with the numeral 116*a*. This front fold edge 116*a* includes a first front fold 116*a'* formed at the junction of the front portion 118 and an intermediate portion 42. The intermediate portion 42 extends from the fold 116*a'* to an intermediate fold 116*b*. From fold 116*b*, a second intermediate portion 44 extends to the second front fold 116*a''*.

As is seen in FIG. 8, the shingle ridge cover 116 may have a folded front (or lower) edge 116*a*, which is of substantially four (4) times the thickness of the sheet shingle material (i.e., of work piece 116'), and may make a respectively visible step on a roof along a ridge, hip, or rake, as well as a respectively heavy shadow line on the roof While the present invention has been depicted, described, and is defined by reference to a particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. Accordingly, the depicted and described preferred embodiment of the invention is exemplary only, and is not exhaustive of the scope of the invention. Consequently, the invention is intended to be limited only by the spirit and scope of the appended claims, giving full cognizance to equivalents in all respects.

We claim:

1. A front-folded, double-coverage shingle ridge cover comprising:

an elongate work piece of sheet shingle material having an upper granular-coated face, and said elongate work piece being folded double on itself transversely intermediate of the length of said work piece to define a folded front lower end edge of said ridge cover, and an elongate upper portion having a determined length extending from said folded front lower end edge to an upper end edge defined by said elongate upper portion, and an elongate rear portion having a length dimension which is a major fraction of said determined length, so that said elongate upper and rear portions are integrally united at said folded front lower end edge of said ridge cover, with said upper portion having said granular-coated face disposed upwardly and away from said rear portion;

said upper portion being generally rectangular in shape and said rear portion being generally trapezoidal in shape with a base edge of said trapezoidal shape uniting with said upper portion at said folded front lower end edge, so that said rear portion is narrower than said upper portion over substantially the entire length of said rear portion and so that opposite side edges of said rear portion are substantially concealed behind said upper portion;

and in which said rear portion defines a centrally located relief slot extending between said folded front lower end edge and a respective upper end edge of said rear portion.

2. The shingle ridge cover of claim 1 wherein said rear portion adjacent to said respective upper end edge thereof remote from said folded front lower end edge of said shingle ridge cover includes a rearwardly facing transverse strip of non-adherence material, and at a front face of said shingle ridge cover obverse to and congruent with said transverse strip of non-adherence material said upper portion of said shingle ridge cover including a transversely extending area of adhesive material; whereby when plural shingle ridge covers are stacked one atop another in like orientation said area of adhesive material of one shingle ridge cover confronts said transverse strip of non-adherence material of a next-adjacent ridge cover and substantially does not adhere thereto.

3. A front-folded, double-coverage shingle ridge cover comprising:

an elongate work piece of sheet shingle material having an upper granular-coated face, and said elongate work piece being folded double on itself transversely intermediate of the length of said work piece to define an upper portion and a rear portion, which portions are united at a folded front lower end edge of said ridge cover, with said upper portion having said granular-coated face disposed upwardly and away from said rear portion;

said upper portion being generally rectangular in shape and said rear portion being generally trapezoidal in shape with a base edge of said trapezoidal shape uniting with said upper portion at said folded front lower end edge, so that said rear portion is narrower than said upper portion over substantially the entire length of said rear portion and so that opposite side edges of said rear portion are substantially concealed behind said upper portion;

in which said rear portion defines an angulated pair of oppositely extending thermal relief slits each extending from adjacent said folded front lower end edge of said shingle ridge cover and angularly to terminate at a respective angulated side edge of said rear portion, thus to define within said trapezoidally shaped rear portion a part of irregular hexagon shape.

4. The shingle ridge cover of claim 2, in which said upper portion on a back face thereof also includes a respective transverse strip of non-adherence material, and said transverse strip of non-adherence material on said rear portion being substantially congruent with and overlying said transverse strip of non-adherence material on said upper portion.

5. The shingle ridge cover of claim 4, in which said respective transverse strip of non-adherence material includes a strip of mylar tape.

6. The shingle ridge cover of claim 2, in which said transverse strip of non-adherence material includes a strip of mylar tape.

7. A shingle ridge cover for roofing; said shingle ridge cover comprising:

an elongate work piece of sheet shingle material having a face substantially covered with granular material;

said work piece including an elongate upper portion of generally rectangular shape and having a determined length dimension, integrally joining with an elongate rear portion of generally trapezoidal shape and having a respective length dimension which is a major fraction of said determined length, and said work piece being folded double on itself intermediate of the length of the work piece at a transverse line of integral joining of the upper portion and rear portion to define a folded front lower end edge of the shingle ridge cover, and to overlap said upper portion and said rear portion; and said upper portion including an upwardly disposed transverse area of adhesive material, and an upper nailing margin defined by said determined length dimension of said upper portion being longer than said respective length dimension of said rear portion; and said rear portion carrying a rearwardly disposed transverse strip of non-adherence material, said transverse strip of non-adherence material being generally aligned and congruent with and oppositely disposed relative to said transverse area of adhesive material.

8. The shingle ridge cover of claim 7, in which said rear portion defines a centrally located relief slot extending between said folded front lower end edge and an upper end edge of said rear portion.

9. A shingle ridge cover for roofing; said shingle ridge cover comprising:

an elongate work piece of sheet shingle material;

said work piece including an upper portion of generally rectangular shape, joining with a rear portion of generally trapezoidal shape, and said work piece being folded double on itself intermediate of the length of the work piece at a transverse constructive line of joining of the front portion and rear portion to define a folded front lower end edge of the shingle ridge cover, and to overlap said front portion and said rear portion; and said front portion including an upwardly disposed transverse area of adhesive material and an upper nailing margin spaced from said folded front end edge of said shingle ridge cover; and said rear portion carrying a rearwardly disposed transverse strip of non-adherence material, said transverse strip of non-adherence material being generally aligned and congruent with and oppositely disposed relative to said transverse area of adhesive material;

in which said rear portion defines a pair of oppositely angularly disposed thermal relief slits, each extending from substantially adjacent to said folded front lower end edge angularly to a respective angulated side edge of said rear portion, thus to define within said trapezoidally shaped rear portion a part of irregular hexagon shape.

10. The shingle ridge cover of claim 7, in which said upper portion also carries a respective transverse strip of rearwardly disposed non-adherence material, and said transverse strip of non-adherence material on said rear portion and said respective transverse strip of non-adherence material on said upper portion being substantially congruent with and overlying one another.

11. A manufacturing intermediate article for making plural front-folded shingle ridge covers, said manufacturing intermediate article including an elongate strip of shingle material defining a longitudinal line of symmetry, and plural shingle ridge cover work pieces oppositely disposed on opposite sides of said line of symmetry and each extending laterally from said line of symmetry, on each side of said line of symmetry said manufacturing intermediate article including a spaced apart pair of longitudinally extending strips of non-adherence material each disposed on a respective opposite side of said article and extending across plural ridge cover work pieces, and on a front face of said article and on opposite sides of said line of symmetry said article including a pair of spaced apart linear areas of adhesive material also extending across said plural shingle ridge cover work pieces and each congruent with and obverse to a respective strip of non-adherence material.

12. A method of providing a front-fold shingle ridge cover for roofing, said method comprising steps of:

providing an elongate work piece of shingle roofing material, said work piece having a length dimension and a width dimension and including an upper portion of generally rectangular shape joining at a transverse constructive folding line with a rear portion of generally trapezoidal shape, configuring said rear portion to have a base edge at said transverse constructive folding line, and a pair of angulated side edges extending to a minor edge substantially parallel to and spaced from base edge, providing said work piece at an upper side with a coating of protective granular material;

forming a fold in said work piece cross wise thereof and intermediate of the length of the work piece to define at said fold a front end edge of said shingle ridge cover, and disposing said upper portion atop of said rear portion;

providing for said side edges of said rear portion to be substantially concealed behind said front portion;

further including steps of: providing on said front portion an upwardly disposed transverse area of adhesive material, and on said rear portion providing a rearwardly disposed transverse strip of non-adherence material congruent with said area of adhesive material; and stacking plural like-oriented shingle ridge covers one atop the other, while confronting and engaging said area of adhesive on one ridge cover against said transverse strip of non-adherence material of a next successive ridge cover; and substantially prevented successive ridge covers from adhering to one another.

13. A front-folded, double-coverage shingle ridge cover comprising: an elongate work piece of sheet shingle material having an upper granular-coated face, and said elongate work piece being folded double on itself transversely intermediate of the length of said work piece to define a front folded lower end edge for the ridge cover, and an upper portion and a rear portion substantially parallel to one another, which portions are united at said folded front lower end edge of said ridge cover, with said upper portion having said granular-coated face disposed upwardly and away from said rear portion, and said rear portion having a granular coated face disposed away from said upper portion; said upper portion being generally rectangular in shape and said rear portion being generally trapezoidal in shape with a base edge of said trapezoidal shape uniting with said upper portion at said folded front lower end edge, so that said rear portion is narrower than said upper portion over substantially the entire length of said rear portion and so that opposite side edges of said rear portion are substantially concealed behind said upper portion, and wherein said rear portion adjacent to an upper end edge thereof remote from said folded front lower end edge of said shingle ridge cover includes a rearwardly facing transverse strip of non-adherence material, and at a front face of said shingle ridge cover obverse to and congruent with said transverse strip of non-adherence material said upper portion of said shingle ridge cover including a transversely extending area of adhesive material; whereby when plural shingle ridge covers are stacked one atop another in like orientation said area of adhesive material of one shingle ridge cover confronts said transverse strip of non-adherence material of a next-adjacent ridge cover and substantially does not adhere thereto; and which said rear portion defines an angulated pair of oppositely extending thermal relief slits each extending from adjacent said folded front lower end edge of said shingle ridge cover and angularly to terminate at a respective angulated side edge of said trapezoidally shaped rear portion, thus to define within said trapezoidally shaped rear portion a part of irregular hexagon shape; and in which said upper portion on a back face thereof also includes a respective transverse strip of non-adherence material, and said transverse strip of non-adherence material on said rear portion being substantially congruent with and overlying said transverse strip of non-adherence material on said upper portion.

* * * * *